United States Patent [19]

Walton

[11] Patent Number: 4,597,579

[45] Date of Patent: Jul. 1, 1986

[54] THREE-DIMENSIONAL ASSEMBLY PUZZLE WITH ASYMMETRICAL PIECES THAT INTERLOCK INTERCHANGEABLY

[76] Inventor: Dale W. Walton, 301 W. 31st St., Richmond, Va. 23225

[21] Appl. No.: 729,187

[22] Filed: May 1, 1985

[51] Int. Cl.[4] ..... A63F 9/12

[52] U.S. Cl. ..... 273/156; 273/160

[58] Field of Search ..... 273/156, 157 R, 160; 52/DIG. 10

[56] References Cited

U.S. PATENT DOCUMENTS

| | | | |
|---|---|---|---|
| 3,547,444 | 12/1970 | Williams et al. | 273/157 R X |
| 3,578,331 | 5/1971 | De Gast | 273/157 R |
| 3,819,188 | 6/1974 | Freedman | 273/160 |
| 3,885,794 | 5/1975 | Coffin | 273/160 |
| 3,949,994 | 4/1976 | Knarr | 273/160 |
| 4,121,331 | 10/1978 | Greene | 273/160 |

*Primary Examiner*—Anton O. Oechsle
*Attorney, Agent, or Firm*—Luedeka & Neely

[57] ABSTRACT

Six physically interchangeable pieces, each corresponding to a pair of adjacent cube edges, have surfaces that allow them to be assembled into subassemblies which, in turn, slide together to create a substantially symmetrical shape. Three fundamentally distinct arrangements of the pieces are possible, each having many possible sequences of assembly. In the final assemblies, the pieces are held together by mutually generated friction, but subassemblies of pieces slide along any of three orthogonal axes. Many external shapes are possible. Varied surface treatments, creating recognizable patterns on the final assemblies, add another significantly higher level of difficulty in these puzzles. One embodiment has holes that make it useful as an organizer on a desk.

20 Claims, 19 Drawing Figures

85
86
87
88
84
89
81
82
54
55
56
57
58
59
83
90
91
92
32
29

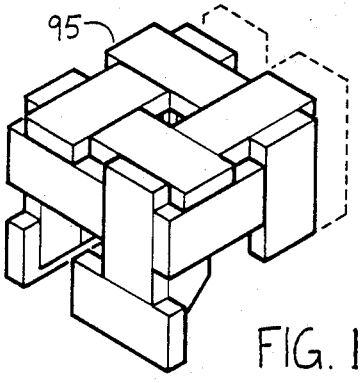
FIG. 15
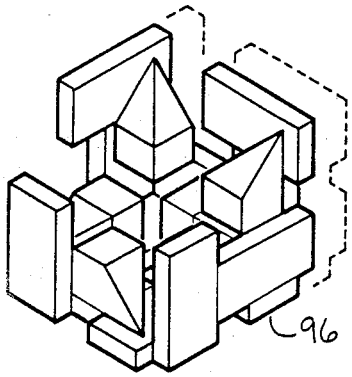
FIG. 16
FIG. 17
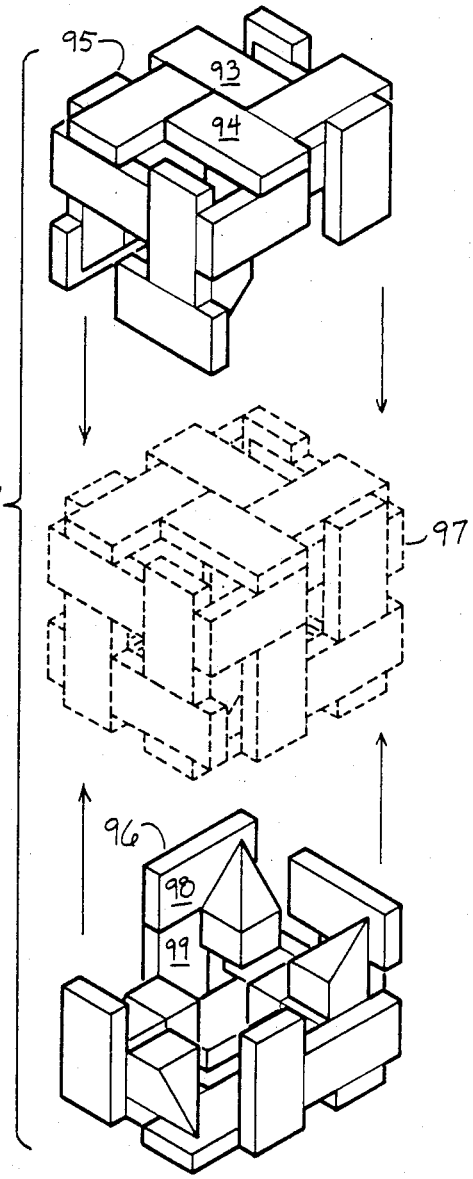
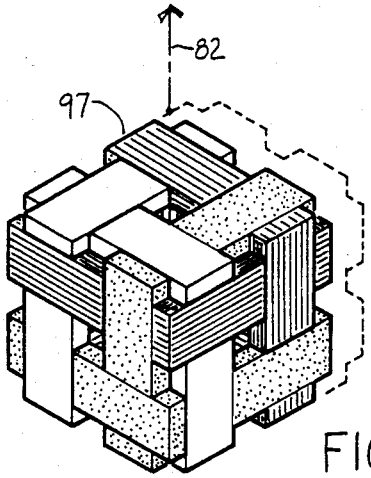
FIG. 19
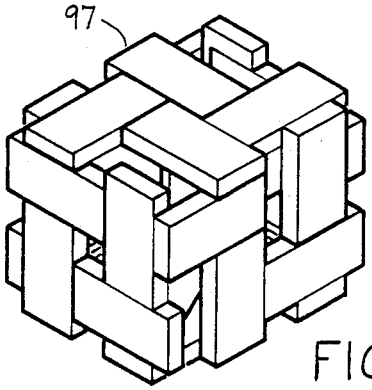
FIG. 18

THREE-DIMENSIONAL ASSEMBLY PUZZLE WITH ASYMMETRICAL PIECES THAT INTERLOCK INTERCHANGEABLY

This invention relates to three-dimensional assembly puzzles, and more particularly to puzzles in which similar pieces are assembled to form a structure based on cubic symmetry. It also relates to puzzles with a single type of interlock between pieces, and more particularly puzzles in which similar, asymmetrical pieces can be mated to each other in a variety of different configurations. It also relates to puzzles and construction toys in which pieces slide apart along orthogonal axes, and more particularly puzzles with interlocking faces on the surface of a cube.

The closest prior art are puzzles with interchangeable or similarly shaped pieces that assemble into symmetrical shapes, particularly shapes with four axes of threefold symmetry, as are found in the tetrahedral and cubic symmetry systems. An important difference between such symmetrical puzzles and this invention, is that the centers of the pieces of such puzzles typically lie on a particular set of the symmetrical axes of the symmetry system to which the puzzle belongs, and there is typically only one arrangement of the centers of such pieces when those puzzles are assembled in a given shape. In contrast, the centers of the pieces of this invention do not lie on any of the axes of symmetry of the shape, and the pieces can be rearranged to form the same shape with centers lying in new locations: in one case, the arrangement of centers has threefold symmetry, in a second case it has twofold symmetry. These differences are due to the fact that the pieces of this invention are each an asymmetrical combination of basic elements of the symmetrical system. Another way this invention differs from many symmetrically appearing assembly puzzles, is that it does not have a key piece and cannot be assembled sequentially piece by piece. Rather, it falls into that class of puzzles which require subassembly. In order to bring out more differences between this invention and prior assembly puzzles, some particular assembly puzzles are cited herein. From these examples and the further descriptive material herein, the differences between this invention and any prior art will become apparent.

U.S. Pat. No. 4,121,831 illustrates a six-piece puzzle with apparent cubic symmetry, and with infacing cubic surfaces. However, the pieces of that puzzle are symmetrical in shape, can be assembled sequentially, and may be fit together to produce more than one assembled shape. Also, in contrast to this invention, the cubic surfaces associated with a piece are not on adjacent faces of a cube, and are obviously not essential as interlocking surfaces to the functioning of the puzzle, since they have no contact with outfacing surfaces and since they have been eliminated in the second embodiment of that puzzle.

U.S. Pat. No. 3,949,994 shows a puzzle with a simple cubic shape similar in appearance to that attainable with this invention. The puzzle shown, however, requires pieces that are not rigid, but rather extend and retract in order to overcome the geometrical problems of assembly, thus adding considerable difficulty to its manufacture. The illustrated puzzle has only four pieces, each is symmetrical and spans the long diagonal of the cube. The puzzle also has no joints meeting at the vertices of the cube. In contrast this invention utilizes pieces without deforming them, the pieces are asymmetrical, they contain no elements directly across the center of the embodied invention from each other, and have joints that meet not only near the fourfold axes of symmetry, but also near the threefold axes.

U.S. Pat. No. 3,885,794 shows a puzzle with cubic symmetry, having six identical pieces that form two subassemblies which slide together. Those pieces have interlocking surfaces parallel to the faces of a rhombic dodecahedron, and slide together along the threefold axis of symmetry. In every solution of that puzzle the pieces have the same geometrical arrangement. Since the pieces each have a twofold axis of rotational symmetry, any two pieces fit together in only one way, or two nonequivalent ways given differentiable pieces. Even if the six symmetrical pieces were all differentiable, there would be only five factorial, or sixty, permutations. In contrast, in the inventions described herein, the primary regions of the interlocking surfaces lie on cubic surfaces, the pieces slide together along the fourfold axes of symmetry, and the pieces may be assembled into three geometrically different arrangements, yielding nine hundred sixty different permutations, given differentiable pieces. Also, any two pieces fit together in six non-equivalent ways, or eleven ways, given differentiable pieces.

It should be noted that the pieces of the invention do not correspond to the mere combination of pairs of pieces found in other puzzles. Existing puzzles with twelve pieces are shaped in a way that would prohibit assembly if the pieces were paired together into six pieces. On the other hand, if the subunits of this invention are not combined into pairs, then the embodied invention becomes unstable and falls apart, unless further means are used to stabilize it. Furthermore, important features of this invention are absent in a structure with unpaired subunits, due to the absence of the asymmetry of the pieces which creates the variety in differentiable ways to arrange the pieces.

Other than assembly puzzles, two major types of puzzles and toys can have interchangeable pieces which fit together into a specific, often symmetrical shape: surface tiling puzzles; and their three-dimensional analogues, packing puzzles and modular puzzles. A feature that those typically share with this invention, is that individual pieces can fit against other pieces in a wide variety of ways; yet, to achieve a particular shape, only a limited number of overall arrangements are possible. This limitation is what makes the puzzles challenging; and is due to the mutual interaction of the pieces, based on their relative positions and orientations, rather than the compatibility of their boundary surfaces. Although this invention, and any assembly puzzle in general, can be considered a volume filling puzzle, it differs from tiling and packing puzzles because it has a specific system of interlocks which hold the final assembly together. Thus, this invention represents a unique mixture of the features of both packing and assembly puzzles, because the challenge of assembling the embodied invention relies both on the positional interactions of interchangeable pieces, and on the restrictions of the sequences and axes of assembly induced by the interactions of the interlocking required to stabilize the invention.

Among planar tiling puzzles the advantages of asymmetrical, interchangeable pieces have been established, and it has also been suggested that such tiling puzzles could be designed to cover the surface of a three-dimensional object, although the combination of these in two ideas apparently has not been embodied in any shell puzzle.

Shell puzzles have a three-dimensional appearance and many varieties of shell puzzles and shell construction toys have been invented. Their pieces substantially conform to the surface of the shape they create, and are relatively thin. Existing shell puzzles with completely interchangeable parts tend to be facile because the physical assembly of the pieces is very straight forward. Therefore, shell puzzles rely on variations of the interlocking regions at the edges of the pieces to add interest. Even such variation is not recognized as sufficient: not only are the edges of the pieces varied, but the pieces are also rendered noninterchangeable. Moving in the opposite direction, when shells are designed for construction toys the pieces are made as versatile and interchangeable as possible since open-endedness, and hence flexibility, is an inherent feature of construction systems. Such systems rarely create interesting piece sets for assembly puzzles with a single shape as a goal. U.S. Pat. Nos. 3,819,188 and 3,547,444 are typical in identifying possibilities for construction systems with interchangeable pieces, and possibilities for puzzles with similar, but noninterchangeable, pieces.

This invention stands in contrast to the features and objectives of shell puzzles in the preceding description. As opposed to the androgynous interlocks described in U.S. Pat. No. 3,547,444, the pieces meet each other at complementary interlocking surfaces. In addition, the interlocking regions comprise a single type and its complement rather than the variations of types found in that patent. Any two of this invention's pieces fit together in half a dozen fundamentally distinct ways due to the variation in orientation and arrangement of their interlocking surfaces, rather than variations in interlock type. The pieces are truly interchangeable. In addition, they are neither inherently planar, nor inherently thin. The pieces do not have a one to one correspondence with single faces of any polyhedron because their positions relative to each other are not the same in every arrangement. Even in a particular arrangement, the pieces are not centered on the faces of a regular polyhedron; as it is not the pieces, but their subunits which are regularly arranged and contribute to the symmetrical appearance of the assembled embodiments.

In contrast to shell puzzles, each arrangement of assembled pieces separates into pairs of subassemblies along each of the three mutually perpendicular axes. Furthermore, the joints are disguised among the natural boundaries in the shape of the embodiments; not all such boundaries conceal joints; and the particular boundaries along which the pieces separate are different depending on the groupings of pieces that move together, which in turn depend both upon the particular arrangement of the assembled pieces and upon the axis along which they are to be separated. In addition, these joints between opposite subassemblies travel back and forth from the equator of the full assembly several times, making it easy to accidentally grasp portions of the same subassembly with opposite hands. Thus without specifically knowing which area of the surface of the assembled pieces slide in a particular direction with respect to another given area, it proves extremely difficult to grasp the embodied invention and separate it into parts. Hence this invention is significantly more difficult to disassemble than shell puzzles.

The interlocking system is also different from that of shell puzzles. Shell puzzles use three primary types of interlock systems. First, dovetailed or necked interlocks similar to jigsaw puzzles, as in the puzzle illustrated in U.S. Pat. No. 3,578,331. Second, frictional interlocks produced along piece edges by pairs of opposing planes, oriented normal to both the edge and the adjacent surfaces of the exterior of the shell, as found in puzzles illustrated in U.S. Pat. Nos. 3,819,188 and 3,547,444. Third, frictional interlocks produced by pegs and corresponding holes lying within piece edges, typically oriented normal to the edge and parallel to the surface of the shell. The thin shells are generally not stable enough to rely on multiple piece interactions to provide the primary means of support. Hence, each piece positively interacts at its edges with its neighbors. In some cases, shell puzzles require backing or additional support. The second embodiment in U.S. Pat. No. 3,578,331 is an example. The shells may be required to be thin when neck interlocks are used, to allow the necked portions to be removed from adjacent pieces at slightly different angles, depending on which piece is removed first. When shell puzzles have polyhedral shapes, the pieces are essentially planar and represent single faces of polyhedrons. Such polyhedral shell puzzles generally rely on the second type of interlocks, with opposing surfaces, to allow any regularly polygonal pieces to be removed radially. Shell puzzles of the peg type, on the other hand, divide in half and in half again until they are disassembled. In all three types, the interactions between isolated interlocking pair of pieces is limited to relative motion in only two dimensions: to motion within a plane. True three-dimensional interactions between pairs of pieces in those puzzles, then, is not inherent in their design.

This invention produces assemblies which are extremely stable without requiring interlocks of the three forms described for shell puzzles. Rather, the embodiments of this invention allow relative motion between isolated pairs of interlocking surfaces to occur within the domain included by a solid angle defined by their functionl regions. The relative direction in which any two pieces in this invention slide apart from each other is dependent on the arrangement of the pieces in the particular solution and on the sequence in which the embodied invention is taken apart. Therefore, a given pair of interlocking surfaces does not provide a positive frictional connection between pieces by itself; but works in conjunction with additional interlocking surfaces, which in the majority of cases involve additional pieces. Hence all the pieces must be considered mutually supporting; as opposed to the pieces of shell puzzles, which independently support each adjacent piece.

Although the pieces of some embodiments of this invention appear to contain an interlock of the second shell puzzle type, with opposing faces; on closer inspection this interlock between two pieces turns out to be an artifact of the geometrical system upon which the invention is based and not a true mating of complementary interlocks. A demonstration of this point is given by the fact that the male portion of this apparent interlock pair is found to fit in several other locations around the perimeter of the piece where no frictional fit is involved, and where, in the final assembly, it lies between two pieces and in contact with them both. Hence, the apparent male part cannot be considered as a single element of the embodied invention, but rather as the combination of two functionally distinct interlocks, and therefore, the female portion must be considered correspondingly.

That the pieces of this invention act collectively to hold each other together, rather than having strong binary connections between adjacent pieces, is a beneficial feature that increases the challenge presented to the user in various ways. Firstly, many binary combinations of the pieces are unstable; and, if left while working on other parts of the embodied invention, will come apart and lose their relationships. Thus the assembler is forced to commit himself to particularly stable pairings or to fitting more than two pieces together before concentrating on their possible relationships to the remaining pieces. Secondly, the manners in which the pieces may be paired are much more difficult to recognize because they do not have a firm or obvious fit in every pairing, thus reliance cannot be made on the tactile sensation of pieces fitting as confirmation that a particular relationship is valid. In fact, it will be very difficult even to identify the potential ways in which two pieces may fit together, since the interlocking surfaces do not in general have opposing regions or easily identifiable features.

A further difference between this invention and the first two categories of shell puzzles is that this invention requires subassembly and cannot be assembled by the sequential addition of pieces one at a time. Though the third category, shell puzzles with pegged edges, requires subassembly, it does not allow any piece to slide in more than one direction with respect to an adjacent piece. In contrast to all three, the manner of subassembly of this invention is not obvious and lends to the overall difficulty and enjoyment of the invention. The pieces of this invention, though interchangeable, yet function differently in different locations in the invention and its subassemblies. The specific subassemblies depend on which of three possible geometrical arrangements of the assembly is desired, and upon the sequence of assembly. Furthermore, some of the subassemblies are based on the division of the pieces into two unequal groups. These features are not found in the prior shell puzzle art.

As mentioned previously, packing puzzles are three-dimensional puzzles which rely on collective relationships among relatively interchangeable pieces to provide challenge and interest. Most of those puzzles are packed into containers, or are piled or stacked on special surfaces to stabilize them. Few hold together if lifted up or tossed in the air, in contrast to assembly puzzles. However, a certain related class of puzzles lies between those two. Those are three-dimensional modular puzzles, and they normally have open-ended objectives. They are based on the concatenation of solids that belong to a space filling system, such as octahedra plus tetrahedra; or more relevantly, cubes. Puzzles and construction toys based on the concatenation of cubes can separate primarily along the three orthogonal axes of the cubes that form them and certain regions of each piece can be on the surface of a cube.

The objective of cube concatenation puzzles and toys are different. Though there are many types, a few significant generalizations follow. In the cases in which the pieces are identical in shape, the object is either to assemble a puzzle of the same shape as the pieces, or to create a open ended puzzle, game and/or construction toy. The pieces in this invention, however, fit together to create a completed assembly having a particular shape, different from the shape of its individual pieces; a shape which will be recognized by the ordinary person as the only solution shape acceptable. Even though the pieces may be arranged in various ways to assemble this shape, they do not lend themselves to arbitrary assembly, unlike pieces of concatenated cubic puzzles and toys. Furthermore, the pieces of this invention hold tightly together when assembled, as opposed to most concatenated cube puzzles, which fall apart; but taken in pairs hold together poorly, as opposed to the construction toys based on cubes, which hold together.

The primary objective of this invention is to provide a generalizable system for interlocking pieces together in three-dimensions, suitable for puzzles and similar devices. Additionally, it is the objective of the invention to devise such a system having desirable properties for puzzles.

The most important property of a system of puzzles is that it be open ended; that is, that it allow for the creation of puzzles having a wide range of different appearances and levels of difficulty, while remaining similar from the view point of design and manufacture. Secondly, the pieces should be identically shaped with respect to their interlocking parts, as this eliminates the need for different moulds or jigs to create the surfaces that require the greatest precision in manufacture. Thirdly, pieces should be completely interchangeable. Fourthly, their interlocking parts should be maximally interchangeable so that pieces may be fitted together in a large number of ways. Fifthly, the various ways a pair of pieces fit together should be geometrically distinct so that the location and orientation of a given piece with respect to another is not arbitrary. Sixthly, the shape of the pieces should not be suggestive of the sequence in which they must be assembled; as opposed to puzzles with key pieces, and puzzles in which only a specific piece may be added at any one time. Seventhly, the manner of interlocking should not be apparent from the assembled puzzles; that is, the manner in which pieces meet together on the exterior surface of the puzzle should be minimally constrained by the system of interlocking, and their boundaries neither reveal an obvious pattern of interlocks such as the patterns found on jigsaw puzzles and the like, nor be indicative of the manner in which the puzzle may be disassembled. Eighthly, the system should permit forms which are amenable to surface differences such as coloration, due to their symmetry and complexity, to enhance the attractiveness and add a level of difficulty to the puzzles beyond the challenge of geometrical assembly. To retain the interchangeability of the pieces, such coloration should not require the same color to continue across the boundary from one piece onto another. Lastly, such a system should be relatively simple to understand in principle, from the point of view of one designing pieces and overall shapes for the puzzle; while remaining difficult to assemble in practice. Of course, the system may lend itself to allow designs using less than all these advantages.

In addition to the objective of creating a system of puzzles, it is an objective of this invention to set forth specific embodiments with pieces that may easily be created from either moulded or milled parts; being composed of subunits that do not contain parallel planes on facing surfaces, and which in turn are composed of simple components joined together in regular ways.

The invention is a system of six pieces relating to a cube, that geometrically lock together into a shape of substantially symmetrical appearance that may be assembled and disassembled repeatedly by sliding groups of pieces together and apart. The exterior surface divides, when the puzzle is disassembled, along natural boundaries that run from the vicinity of fourfold axes of symmetry to the vicinity of threefold axes of symmetry. The mutual interaction of the pieces produces friction that prevents the assembly from falling apart. Each piece corresponds to two adjacent edges of the cube. Each edge of the cube corresponds to one of two subunits of a piece. With respect to the shape of their interlocking surfaces, the subunits are interchangeable with each other and are also interchangeable with themselves by a rotation through 180° about the twofold axis associated with the edge of the cube. Corresponding parts of subunits meet together symmetrically around the threefold and fourfold axes, and, since the axes themselves cannot be divided equally among the subunits, they are located between pieces.

The pieces, although interchangeable, are not symmetrical because the subunits span across the edges of the cube at an angle, so that the end of one joins into the side of the other to form the piece. Because the pieces are not symmetrical, their mirror images are not the same as themselves. Thus any puzzle designed under this system has a mirror image that is a geometrically distinct puzzle under the system and its pieces are geometrically incompatible with those of the mirror image puzzle.

The associations of each piece to a pair of adjacent cube edges and to a handedness caused by the asymmetrical nature of the junction of the subunits, are fundamental features of the pieces, invariant despite changes in the geometrical shapes of the pieces or their interlocks. These features determine the fundamental distinctions among arrangements of sets of pieces, as opposed to distinctions arising from geometric, decorative, or other features of the pieces. There are three fundamentally distinct ways the six pieces of the system can be arranged in the final assembly. These correspond to the three distinct arrangements in which the edges of a cube may be paired: one with threefold symmetry about a corner axis, one with twofold symmetry about one of the face axes, and a third that is mirror image of the second. The mirror arrangements of pieces, in contrast to the mirror arrangements of the paired cube edges, are substantially distinct from each other and not true mirror images, due to the handedness of the composite pieces. A true mirror image of the puzzle is a geometrically incompatible puzzle.

Close inspection of the three arrangements reveals that the pieces in each arrangement may be differentiated into types according to their relationships to the other pieces in the puzzle. In the arrangement with threefold symmetry, there are two such positional types with three pieces of each type. In each of the arrangements with twofold symmetry there are three such positional types with two pieces of each type. Thus in total, for the solvable arrangements of the system, there are $2+2+3$, or eight, positionally differentiable types of pieces. Other arrangements of neighboring pieces are possible, but lead to gaps in the assembly and hence yield no solution. With this information, the total number of possible piece arrangements can be calculated for the case in which each piece is uniquely marked. A first piece can be located in any one of the eight different positions, giving a factor of eight and determining a specific arrangement for the remaining pieces. Beacause the piece is asymmetrical, every other position allowed for the remaining pieces is uniquely related to the first piece. Thus the next piece may be in any of five different positions, the following piece in four, then in three, in two, and the final piece is forced to be located in the one remaining position. Hence, the pieces of the embodiments can be arranged in $8\times5\times4\times3\times2\times1$ or 960 permutations. Two hundred and forty (240) of these belong to the fundamental arrangement with threefold symmetry, and three hundred sixty (360) belong to each of the two fundamental arrangements with twofold symmetry.

As mentioned, each piece of this system is made up of two subunits which, for ease of manufacture and symmetry, are substantially the same. The subunits fit one into the other and each subunit has substantially twofold rotational symmetry. Each subunit is centered on and includes the edge axis of the spanned edge of the cube, and its exterior surfaces do not include any other axis of cubic symmetry. Since the subunits fit together, they have complementary interlocks; due to their symmetry, they have two of each type. These interlocks consist of the areas on a subunit which can contact adjacent subunits. These interlocking surfaces must include functional regions described later. On each subunit the complementary interlocks are next to each other and similar interlocks are on opposite sides on the subunits. With respect to the threefold and fourfold axes of the cube, each interlocking surface is positioned similarly to every other interlocking surface. All the interlocking surfaces on all the subunits taken together comprise a set of surfaces that are substantially symmetrical about all the fourfold and threefold axes of symmetry of the cube. The subunits of the embodiments of this invention can be further broken down into simpler, symmetrically arranged components.

The pieces of this invention slide apart in groups, and then individually, along any of the three orthogonal axes of symmetry of the cube. Sliding the pieces apart along other axes is theoretically possible by combining the motions along two or three orthogonal axes simultaneously, but this involves separating the puzzle simultaneously into three or more parts and the friction and dexterity involved makes such an approach impractical. The axes along which the pieces separate are constrained by the interlocking regions. Specifically, they are constrained by a primary region of each interlock which lies against one of the faces of the cube that defines the puzzle, and by secondary regions that are parallel to the edges of that face. The primary elements create most of the required constraint to the motions of the pieces, but allow some undesirable rotations. The secondary regions are necessary to prevent these rotations and to increase the frictional forces; however, they provide more than the minimal requirement for additional stability. Depending on the specific arrangement of the pieces, some of these secondary regions serve as stops, some serve to create opposing planes, some counter possible rotations, and some serve only to maintain the interchangeability of the pieces. Because these secondary regions are redundant in nature, there is a great deal of freedom in their actual placement and orientation. Two secondary regions are required for each interlocking region, each being parallel to a different edge of the face of the cube against which the primary region of the interlock region lies. A puzzle in which all of these regions are mutually perpendicular functions with the least binding, but puzzles with other angles may be devised.

In creating a piece of the invention, one of the four complementary interlocking surfaces on each subunit is consumed by their conjunction, leaving each piece with six of these interlocking surfaces exposed: three of one type and three of the complementary type. The conjunction is such that one interlock of each type is associated with each of three mutually adjacent faces of the cube. Therefore, every piece has infacing and outfacing regions on each of these faces. The interlocking surfaces on each piece are distributed asymmetrically around the piece's surface, each one occupying a unique position, so that any given pair of pieces can be brought together in many ways. Since only one of these arrangements is symmetrical, there are $(6\times2)-1$ or 11 permutations of two different pieces.

The objective that the pieces be interchangeable and fit together in many ways is fulfilled because the set of interlock regions on the subunits, taken as a whole, substantially has rotational symmetry about all the cubic axes of symmetry. This feature in turn places some constraint on the external form of the embodiments since the surfaces which separate the subunits must necessarily extend to the surface of the puzzle. If an asymmetrical appearance were desired, this constraint could be diguised to some degree by varying the depth of the surface at the joints. However, since a symmetrical appearance is the most desireable, the constraint imposed is not disadvantageous. Every joint in the surface of the puzzle must travel from the vicinity of a fourfold axis to the vicinity of a nearby threefold axis. The exact path of the joint is not constrained by the interlock system, as long as it does not double back on itself in a manner which obstructs the orthogonal motions of the pieces. The pieces in a particular embodiment may be reduced in extent and still function perfectly, provided they have the required regions in their interlocks. For example, the pieces may leave large holes at the axes through the centers of the faces of the cube. In principle, the axes may be considered as holes because they are not included in any piece. Thus a wide variety of shapes having surfaces with natural boundaries symmetrically arranged, may be conveniently broken into pieces of this system along their natural boundaries, preserving their aesthetic beauty and concealing the underlying principle of the invention until it is disassembled.

In spite of the fact that all the pieces separate along the orthogonal axes of symmetry, the embodiments of this invention are not easy to disassemble. This is in part due to the fact that the pieces diassemble in groups and not sequentially piece by piece. The pieces and subassemblies are difficult to differentiate from each other in the assembled embodiments. Additionally, portions of a subassembly occupy positions which a person may naturally grasp with opposite hands and attempt to separate; but, since the subassembly must slide as a unit, the puzzle will not come apart this way. These properties are due to features inherent in the system. Firstly, the pieces are hard to differentiate in an assembled embodiment because the shape of the exterior is apparently symmetrical, while the pieces are of an odd shape. Secondly, the joints between pieces are disguised along the natural boundaries in the surface, but not all these boundaries conceal joints, thus it is hard to determine where the actual joints occur. Thirdly, tracing out the boundary of a piece does not make it clear which other pieces must move with it and which must move away from it with respect to a given axis. Similarly, identifying the location of cracks running in the same direction between regions on the surface does not insure that the regions on one side of those cracks will pull away from the regions on the other side when pulled along a given axis. Fourthly, although the pieces have no parts lying on directly opposite sides of the center, they each extend more than half way across with respect to at least two of the three axes they slide along. Hence, portions of every subassembly having more than two pieces, extend beyond the equator with respect to the disassembly axis that produces that subassembly. The majority of ways to disassemble any arrangement produce two such subsassemblies. Thus it is very likely that a person will attempt to pull portions of a given subassembly in opposite directions when trying to initially disassemble the puzzle. The puzzle may contain an additional feature that enhances this effect: the portions that extend across the equator appears to be complete elements separated from the other portions by natural boundaries. Thus it may not be easy to recongize that a particular area could be part of a subassembly that extends across the equator associated with the intended axis of separation.

An additional feature that may be used to complicate assembly and disassembly is to have portions of each of the subunits extend all of the orthogonal midplanes of the cube. They therefore engage each other when the embodiment is divided into subassemblies of three pieces, preventing the total separation of such subassemblies in a single motion. Separation along an additional axis is required to disengage them.

Since an objective of this invention is to provide puzzles that are easily designed and manufactured, the subunits of the embodiments of this invention are composed of simply shaped components that provide all the required interlock regions on their surfaces. It is possible to recombine these specific components in other ways to create related puzzles with substantially the same appearance, but different in particular manner of interlocking. Another modification would be the alternation or omission of some of the regions of some of the interlocks, yielding stable puzzles of a similar nature and appearance, except for incompatibilities between specific pieces or instabilities in particular arrangements. The system also could be modified to create subunits without components, or even with discontinguous interlock regions. In this context, the set of interlock regions would be considered as the union of all interchangeable regions of contact between adjacent subunits.

The foregoing objectives and advantages of the invention, as well as its relationship to prior art, will be more fully understood from the following detailed descriptions of the embodiments of the invention, with reference to the accompanying drawings wherein:

FIGS. 15 through 19 show how the top and bottom sub-assemblies can be manipulated to form the completed puzzle of the second embodiment.

Figure 1:
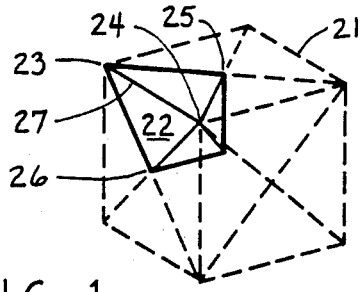
FIG. 1 shows a connective component and its location in a cube.

Referring now more particularly to the drawings, and initially to FIG. 1, there is shown a view of a cube 21 shown in dotted lines with a connector 22 as a component having an edge 27. The connector edge 27 is also one of the twelve edges of the cube. The connector 22 has vertices 25 and 26 which meet at the center of two adjacent faces of the cube and in two other verticles 23 and 24 which meet at the corners of the cube at each end of edge 27. The connector components of FIG. 1 are shown sized to completely fill the cube when twelve of them are assembled together.

Figure 2:
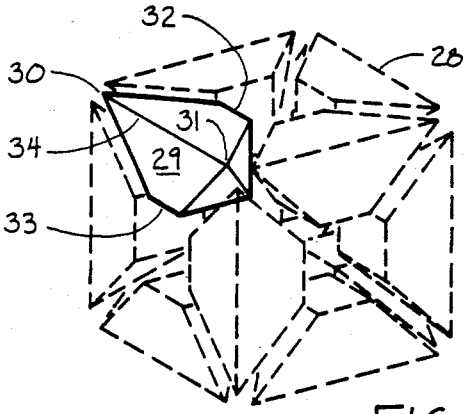
FIG. 2 is similar to FIG. 1 but shows a foreshortened connective component.

FIG. 2 is similar to FIG. 1, but shows cube 28 made of connector 29 being foreshortened so that the verticles 30 and 31 at the end of edge 34 do not come all the way to the corner of the cube and the vertices that would have met in the center of the face of the cube in FIG. 1 are truncated at 32 and 33. This leaves a square shaped hole extending symmetrically around the face centered axis of the cube.

Figure 3:
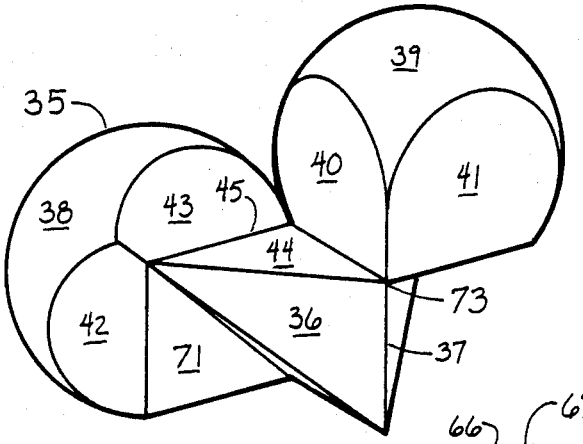
FIG. 3 shows a subunit using a connector and two overlapping balls.
Figure 4:
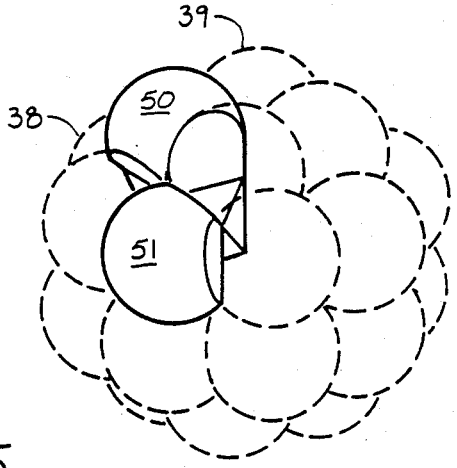
FIG. 4 shows a subunit as part of an assembled puzzle having twenty-four overlapping balls.

FIG. 3 shows a subunit 35 built upon connector 36. In this embodiment, there are shown two truncated spheres or balls 38 and 39 mounted on connector 36. Connector 36 has a vertical edge 37 and an upper outface 44. Ball 39 has two vertical flat faces 40 and 41 and ball 38 has angled flat faces 42 and 43. As will become more apparent later, the subunit 35 is a basic building block whereby two are joined to make an asymmetrical piece and six pieces are assembled together to make the completed puzzle. Such a completed puzzle is shown in FIG. 4 where one subunit is shown in solid lines having two balls 50 and 51. The location of balls 38 and 39 are also shown in FIG. 4 with the entire twenty-four overlapping balls packed tightly together.

Figure 5:
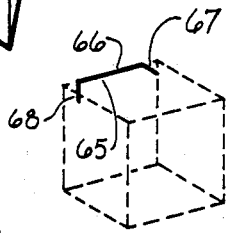
FIG. 5 is a diagrammatic showing of FIG. 3.

Because of the difficulty of visualizing the various subunits, resort is made to a diagrammatic showing with a basic building block being shown in FIG. 5. There a diagrammatic subunit 66 is shown at the edge 65 where two cube faces meet. Hooks 67 and 68 represent the direction along the cube faces the subunit extends.

Figure 6:
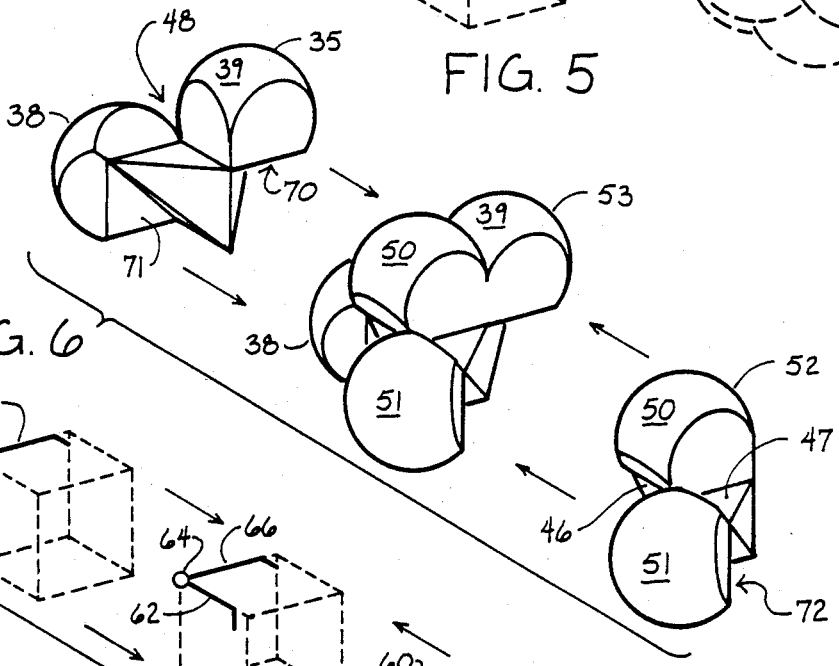
FIG. 6 shows the subunits of FIGS. 3 and 4 combined to form a piece.

FIG. 6 shows the joining together of subunit 35 of FIG. 3 with an identical subunit 52 to form a piece 53. Subunit 52 is made of balls 50 and 51, which correspond repsectively to balls 39 and 38. The two subunits as all of the other subunits, are identical to one another; aand when they are joined into piece 53, such piece is likewise identical to the five other pieces that go to make the complete puzzle. While they are identical in shape, the surface configuration or color of the various balls can be varied to increase the difficulty of assembling the puzzle.

The piece 53 has three outfaces and three infaces. The three outfaces are shown in FIG. 6 at 46 and 47 with outface 48 being on the back side of the connector between balls 38 and 39. The three infaces lie on the inwardly facing sides of ball 39, 38 and 51. The first inface 70 lies on the underside of ball 39. The second inface is shown at 71 on ball 38 and the third inface is the flat side 72 shown on the hidden side of ball 51. The three outfaces are in effect the outer portions of the connectors lying along the surface of the cube and the infaces are lying on the inward facing portions of the balls on the surface of the cube. These inward and outer faces thus form six regions on each piece whereby adjacent pieces contact one another in the assembled puzzle at three mutually adjacent faces of the cube. The remaining faces of each piece that contact adjacent pieces serve to stabilize the adjacent puzzle. They include three regions being parallel to the three orthagonal axes of the cube, respectively. Orthogonal axis is sometimes referred to as the face centered axis of the cube. That is, the axis going between the centers of two opposite faces of the cube.

The terms twofold, threefold, fourfold and vaious axes are terms well known in the field of symmetry and crystallography. An object is symmetrical when it can be moved as a whole to a new position in which all its elements correspond to the elements that formerly occupied their positions. Mirror symmetry occurs when an object can be moved to correspond with its mirror image. An axis of symmetry is a line around which an object may be rotated so that in another position it may correspond to itself. The term fourfold means it repeats itself four times upon rotating 360°. Likewise, threefold means repeating itself three times and twofold means repeating itself twice. In the case of a cube, the face centered axes are fourfold axes of symmetry and there are three of them. The axes which are the long diagonals of the cube, running from one corner to the other, are threefold axes of symmetry and four in number. The axes going from the center of one edge diagonally through the cube to the center of the opposite edge, are twofold axes and six in number.

Figure 7:
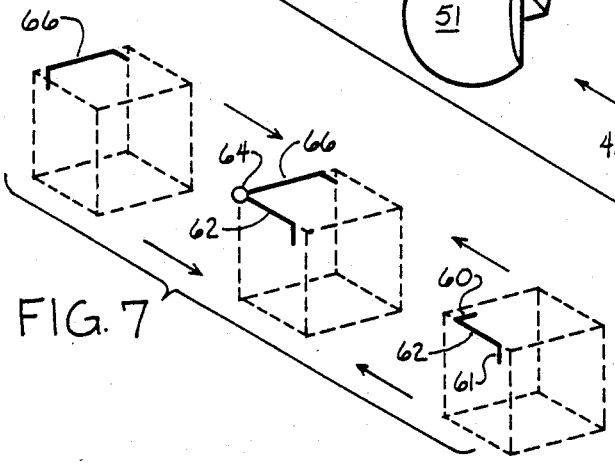
FIG. 7 is a diagrammatic showing of FIG. 6.

The representation of a subunit abstractly in FIG. 5 is carried over into FIG. 7. It is necessary to represent the subunits in pieces abstractly with the diagrams because the shapes of the pieces themselves are complicated and hard to illustrate and would, owing to their complexity, obscure the overall relationships among the subunits and pieces.

FIG. 7 represents a subunit 66 being joined with subunits 62 to make a piece as shown in the center abstraction. The subunit 66 and 62 are in positions that correspond to subunits 35 and 52 in FIG. 6, respectively; while hooks 60 and 61 correspond to balls 50 and 51. The joinder is at the circle 64 where they are connected at a "V" and this indicates that the threefold axis of the cube is not included in the typical piece. The long line segments on subunits 66 and 62 represent the cube edges associated with the subunit and piece. Because this "V" joinder is symmetrical, two tails are shown to give the symbol a handedness. Just as each subunit has been given the same twist with respect to an edge, each tail has the same twist and shows the faces of the cube occupied by the subunit and the circle in effect represents a cube corner nearest the center of the piece.

Figures 9, 10, 11, 12:
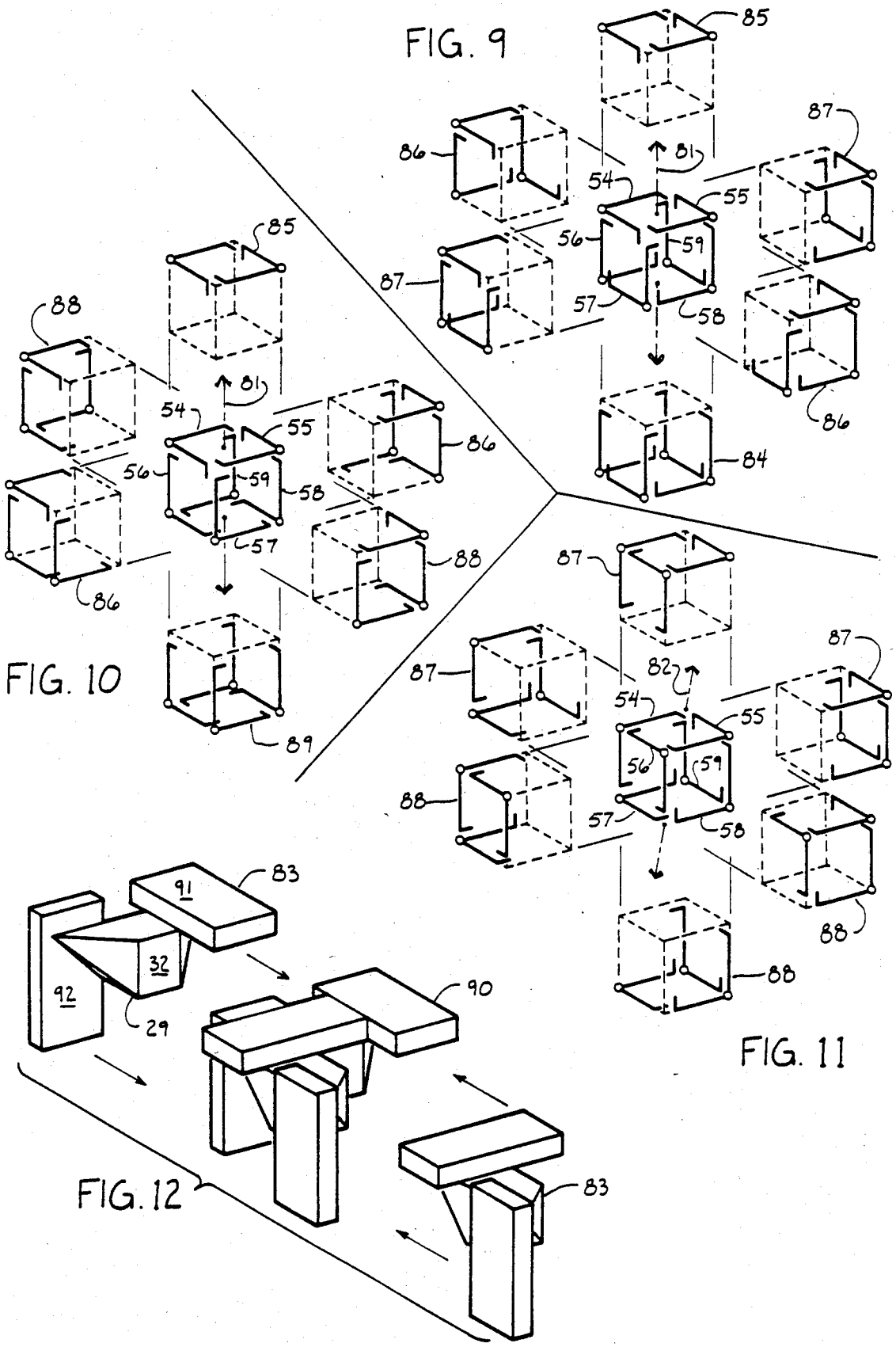
FIGS. 9 through 11 shows the three possible arrangements of the six pieces and their symmetry diagrammatically.
FIG. 12 is a view similar to FIG. 6 showing two subunits of a second embodiment combined to form a piece.

FIGS. 9, 10 and 11 show three possible arrangements of the six pieces using the abstract diagrams just explained. These are the fundamentally three distinct arrangements which the pieces can be assembled. In the arrangement of FIGS. 9 and 10, respectively, the arrangements have axis of twofold symmetry 81 which is also one of the fourfold axes of the cube, and extends through the centers of the cubes bottom and top faces when oriented as shown. In the third arrangement as shown in FIG. 11, the corners around which three pieces meet are located at diagonally opposite corners of the cube from each other and define axis 82 of threefold symmetry for the arrangement, which is also one of the cube's threefold axes. Because the arrangement of FIG. 9 has one axis of twofold symmetry, there are six divided by two or three different positional types of pieces. The arrangement of FIG. 10 yields three more for the same reason. Arrangement of FIG. 11 adds only two more types because it has threefold instead of twofold symmetry. Since arrangements of FIGS. 9, 10 and 11 are the only solutions, the total number of positional types is eight, or two plus two plus three. The six pieces 54, 55, 56, 57, 58 and 59 that go to make a complete puzzle are all shown in the arrangements of FIGS. 9, 10 and 11.

Figure 8:
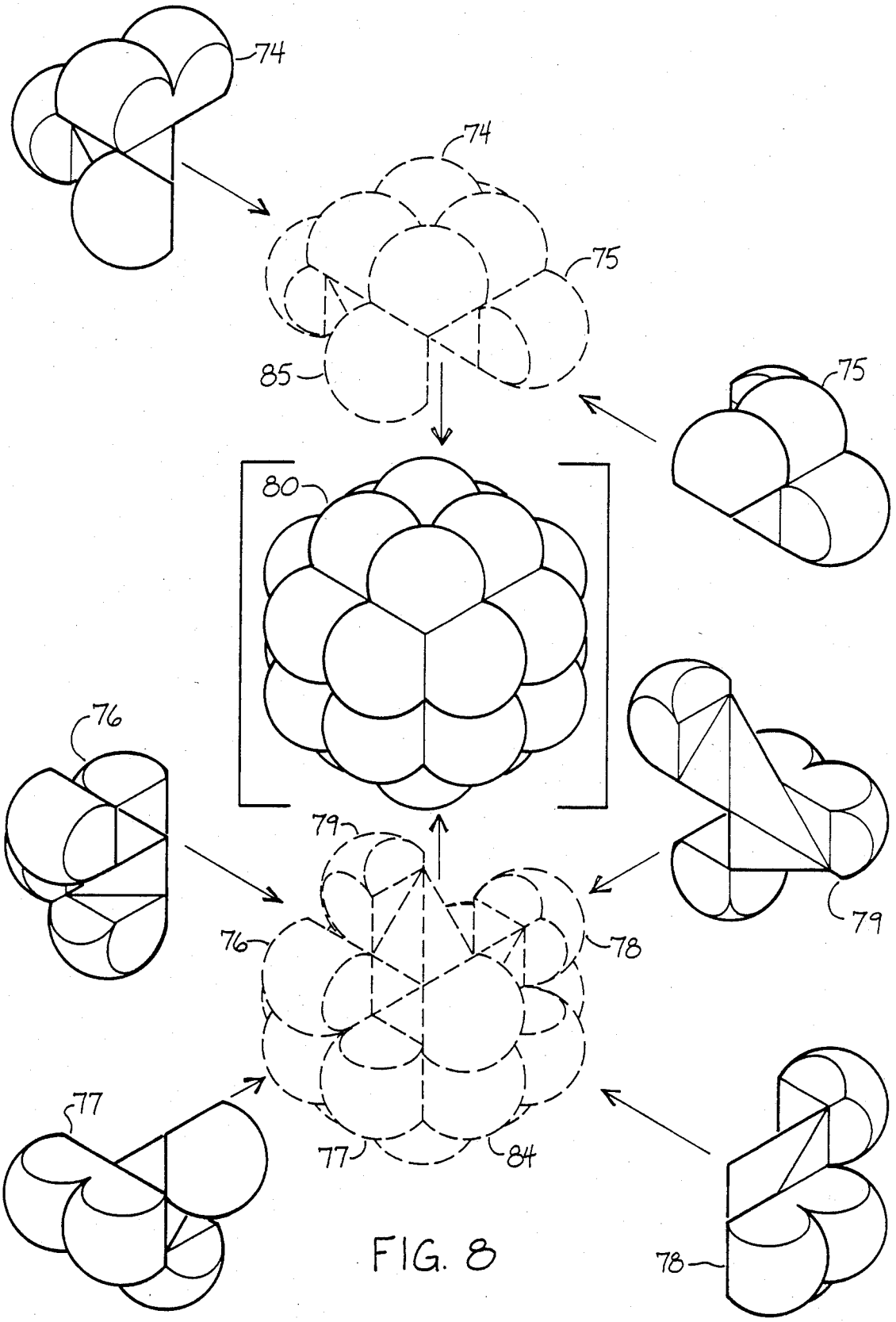
FIG. 8 illustrates how six pieces assemble together to show a first embodiment.

With respect to FIG. 8, there is shown an exploded view of the puzzle indicating how the pieces are assembled to form the complete puzzle. In FIG. 8, pieces 74 and 75 are oriented as shown and are assembled together as shown in the top middle dotted line illustration. Likewise, pieces 76, 77, 78 and 79 are oriented in the manner shown and are slid together to form the subassembly as shown in the middle of the bottom of FIG. 8. The top subassembly comprising pieces 74 and 75 is then slid in a vertical direction to assemble with the bottom subassembly comprising pieces 76, 77, 78 and 79. The completed puzzle is shown at 80 in the center of FIG. 8. When assembled in this manner, pieces 74, 75, 76, 77, 78 and 79 correspond to 54, 55, 56, 57, 58 and 59 respecitvely, as arranged in FIG. 9. It is to be noted that the assembled puzzle has the individual pieces touching along natural boundaries that run from the vicinity of the threefold axes to the vicinity of the fourfold axes.

To increase the complexity of the puzzle and to provide a unique solution and specific piece arrangement, the balls of each piece are colored or else configured in one of six variations. With reference to FIGS. 6 and 8, the balls 38, 39, 50 and 51 would, by way of illustration, be colored respectively as follows: Piece 74 would be blue, green, red and yellow. Piece 75 would be violet, blue, yellow and orange. Piece 76 would be yellow, orange, green and violet. Piece 77 would be orange, red, blue and green. Piece 78 would be red, violet, orange and blue. Piece 79 would be green, yellow, violet and red. The colors blue, violet, red, orange, yellow and green are used by way of example: they could have been yellow, black, dark blue, brown, orange and light blue; or any other colors. The above pattern is selected from many possible patterns for the following criteria: it allows a large number of plausible subassemblies, each piece has a unique set of four colors, each color appears once in each position on the pieces, and the balls produce a different pattern around the surface of the solved puzzle. Other criteria would suggest different color patterns. The coloration possibilities are best explored by computer: a simplified physical model verifies the pattern.

It will be appreciated that the six pieces of the complete puzzle are made of thirty-six components which are convex solids. Twelve of these components are connector pieces and twenty-four of the components are the partial balls or spheres. One of the connectors and two of the balls or spheres are combined to form a subunit that extend from one face around the edge to an adjacent face of the cube. The two subunits are assembled so that in effect three adjacent faces at the corner of the cube are encompassed. The cube is not an arbitrary cube, but rather determined by the regions of contact between the set of connector components and the set of balls or spheres. Some of the connecting surfaces are joined but those that are not joined are served to contact adjacent pieces during the assembly. While this contact occurs across slight distances, it is none the less a contact. The thickness of the plane of contact can be adjusted to produce the desired amount of friction or play in the finished assembly.

While the embodiment illustrated shows the balls or spherical components exposed with the connector internal. This relationship can be reversed and, of course, the balls or spheres is just one means of configuration as will become more apparent when embodiment two is discussed later.

With specific reference to FIG. 3, the ball 39 has been sliced by five planes. Faces 42 and 43 represent slices produced by two diagonal midplanes of the cube that intersect the orthoganal midplanes of the cube. The three remaining slices are faces appearing at the underside of ball 38 and the right hidden side of ball 38 and face 81. The two hidden faces are similar to faces 40 and 41 of ball 39. The two hidden faces of 38 are extensions of the two orthoganal midplanes of the cube and face 71 lies on the surface of the cube. The two hidden face inface 71 intersect at right angles with one another to form a corner such as shown at 73 on ball 39. This arrangement provides the first embodiment of the puzzle with a solid appearance, large interlocking regions and maximal depth to its surface. The balls could be centered anywhere that cuts the five mentioned planes, but the edges of the piece will not align neatly unless the center of the balls lie on the planes that cut the cube diagonally similar to that illustrated in the embodiment, which is believed to be an optimal location.

Since the system of the invention provides a puzzle that is extremely stable, there is no need for the connector components to fill in solidly and their shape is arbitrary to a large degree. Even through the connector components of the first embodiment are shown to make such a solid arrangement, it is not essential that such be done.

It is to be noted that the diagonal faces of the balls of FIG. 3 are at an angle of 135° with respect to face 71. In discussing the number of connector and ball components, it will be of course appreciated that while the balls are physically identical, as well as the connector pieces, the subunits are also physically identical as are the pieces resulting from the combination of two subunits. While balls and connector components and the subunits which they are combined to make are discussed separately, the unitary members provided with the puzzle for assembly are actually the pieces which are made up from two of the subunits. The pieces, subunits, balls and connector components are all physically identical, it being understood that rather than being merely joined together, they can be joined together by being injection molded as one piece or otherwise fabricated to form the unitary piece.

The discussion as to physical identity is to be distinguished from varying the surface configurations or colors or materials of the balls to distinguish such surface if it is decided that the puzzle should be made more complicated by having such variations. By using the six variations of the balls, through color, surface texture or the like, a unique solution out of 960 permiations are provided. Thus, making the puzzle very complicated.

Again, with reference to FIG. 3 and FIG. 8, together with similar FIGURES, it is seen that each ball component has four adjacent ball components with which it is in contact along its various faces. Likewise it is seen that the connector component is in contact with four of the ball components. In FIG. 3, two of these balls are shown and a third ball will be in contact with outface 44 and the fourth ball would be in contact with outface 67 of FIG. 6. Thus, the puzzle components are two symmetrical groups with the first group comprising the twenty-four balls each having a region of contact with four adjacent ball components and the second group comprising twelve connector components which are mutually similar, each having a region of contact with four of said ball components. These regions of contact on the connector components are two regions. One on one face of a cube and the other on the adjacent face of a cube such that when the ball components and the connector components are assembled into pieces, each piece has six exposed regions on the surface of a cube comprising an in facing and out facing region on each of three adjacent faces of a cube near a corner thereof.

It will be appreciated that the subunits based on these components also form a symmetrical set because the components that make up the subunits relate to the respective cube edges in the same way. Likewise the interfaces, or areas of contact, betweent the subunits form a symmetrical set of twenty-four identical interfaces. One such interface occurs between regions 40, 43 and 45 of subunit 35 and the corresponding regions they contact on subunit 52. Part of this same interface also extends down over the vertical face of connector 36. The set of said interfaces has the same kinds of rotational symmetry as a cube, and its axes of symmetry correspond to the axes of the cube that separates the two sets of components. The identical nature of the areas of contact between the subunits provides the feature of interchangeability among the pieces.

Referring to FIGS. 9, 10 and 11 the pieces can mate in six substantially distinct ways, represented by 54 and 55, 54 and 56, 54 and 57, 54 and 59, and 56 and 59 as arranged in FIG. 9, and 54 and 59 in FIG. 10. It has already been noted that the pieces can be assembled into the three distinct arrangements. These arrangements in turn separate into pairs of subassemblies along three mutually perpendicular axes. The type of subassembly depends on both the arrangement and the axis along which the puzzle is separated. These subassemblies comprise six substantially distinctive arrangements of pieces 84, 85, 86, 87, 88 and 89 that relate to the final arrangements as shown in the FIGS. 9, 10 and 11. Referring to FIG. 8, subassemblies 84 and 85 are shown.

While balls have been mentioned in the first embodiment, other numerous types of surface configurations can be utilized. The second embodiment will show one of these other arrangements plus an added feature that makes it an even more difficult puzzle. Many of the principles and characteristics of the second embodiment are similar or identical to those principles and characteristics of the first embodiments, so much of what has already been stated will not be repeated.

FIG. 12 shows a subunit 83 having a foreshortened connector piece 29 with two rectangular blocks or orthogonal blocks 91 and 92 joined with connector piece at right angles to one another. Two of the subunits 83 are assembled together to form a unitary piece 90. Each of the subunits are identical physically and there are six pieces which are physically identical to make up the components for a complete puzzle. Likewise, the areas of contact between subunits are identical with each other, and form a set of interfaces will all of the rotational symmetries of the cube. The foreshortened or truncated connector piece at 32 provides for an opening through the center of the assembled puzzle similar to that shown in FIG. 2 and better shown in FIG. 19. The center openings provide for a ready means of manipulating the puzzle and also permits it to be used on a desk top to hold pencils and similar objects.

Figure 13:
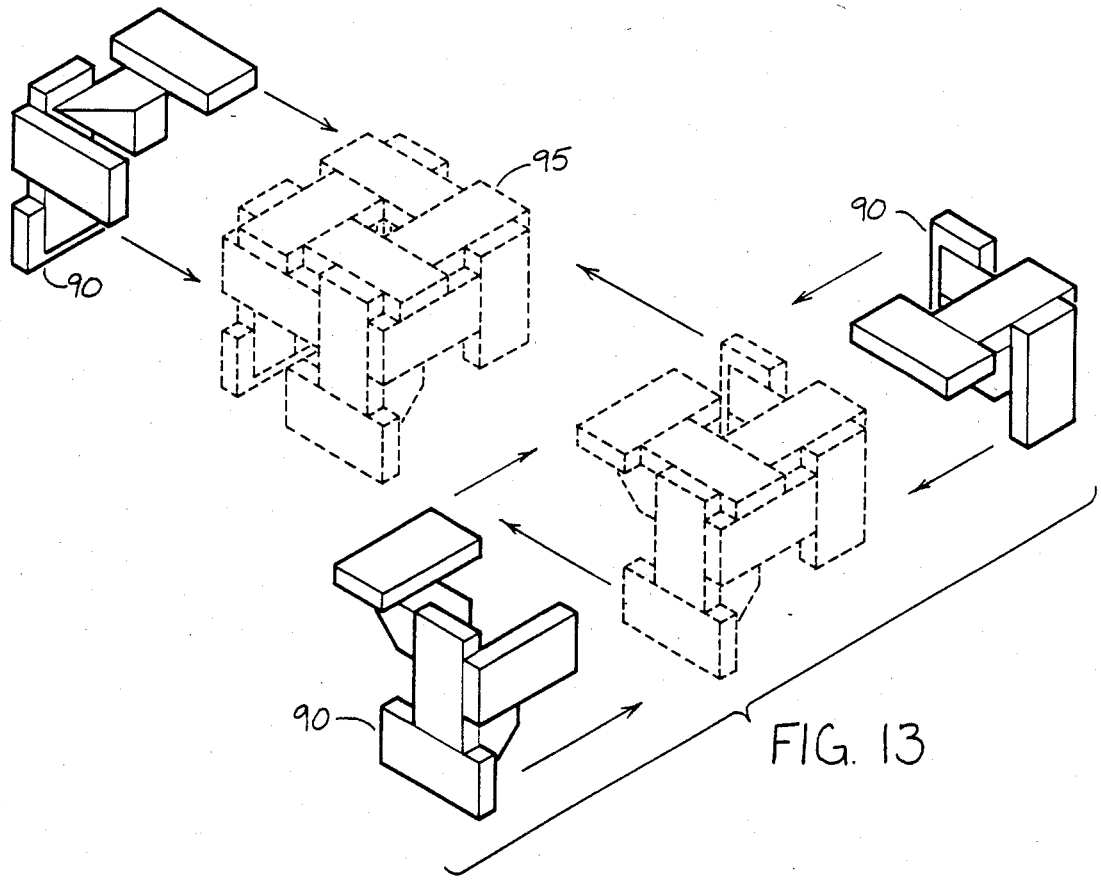
FIGS. 13 and 14 are views showing how three pieces of the second embodiment can be assembled to form, respectively, the top and bottom halves.
Figure 14:
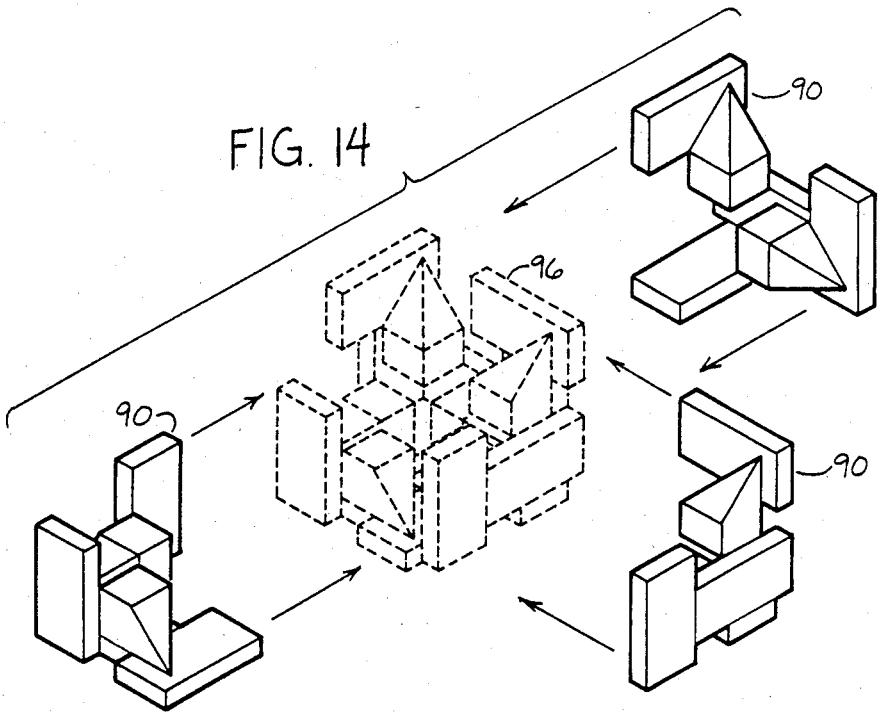

FIGS. 13 and 14 show pieces 90 being assembled into a top subassembly 95 and a bottom subassembly 96, respectively. The connector components of the second embodiment are completely separated from each other by gaps. This conclusively demonstrates that the puzzle system is fully stable without any regions of contact beyond those defined in the description. This arrangement also creates a pleasing visual effect because the connector components appear suspended on the inside of the embodiment. Since they do not meet, less care is required in forming their in facing surfaces and in locating the components precisely.

The orthogonal blocks surround a cube whose edge has a length equal to the block's length plus width minus its thickness or, to put it another way, the cube's edge length minus the block's thickness is equal to the block's length plus width. Also, a block's length is greater than its width plus thickness. The blocks extend a distance beyond the middle of the face of the cube on which they lie, which is a major difference from embodiment one. Because of this feature, the subunits of the second embodiment each extend across every orthogonal midplane of the cube a short distance. These extensions engage each other during disassembly and thus increase the difficulty of the puzzle.

Referring to FIGS. 9, 10 and 11, the blocks specifically engage when separating the embodiment into subassemblies 86, 87 and/or 88. They also engage during the disassembly of subassembly 89. The arrangement shown in FIG. 11 is especially significant in this respect because it only divides into subassemblies 87 and 88, and cannot be disassembled without the extensions of the blocks engaging. The FIGS. 13, 14, 15, 16, 17, 18 and 19 show a method of assembling the pieces into the arrangement illustrated in FIG. 11.

FIGS. 15 and 16 show the subassembly 95 and 96 respectively and indicate with dotted lines that they must be expanded to the position shown in FIG. 17 in order to be assembled. FIG. 17 shows block 94 moved until it engages with block 93 in subassembly 95; while in subassembly 96, block 98 has been moved to align with block 99. The expanded subassemblies 95 and 96 then can be carefully assembled into the expanded final assembly 97 shown in the middle of FIG. 17 in dotted lines and in solid lines in FIG. 18. The expanded final assembly can then be collapsed from the dotted line into arrangement 97 as shown in FIG. 19.

Disassembly can be initiated most easily when one pulls the puzzle apart from the holes in opposite sides because the opposite holes always lie on opposite subassemblies. While the other components on the side most easy to grasp often do not.

Thus, it is seen that the second embodiment has the appearance of six interwoven square bands which are three sets of two parallel bands. Surface color, texture or choice of material for the blocks in the various bands can require a unique solution to the puzzle in order to have each band of the same appearance.

FIG. 19 illustrates such a pattern of three textures and their relationship to the axis 82 of threefold symmetry of the arrangement of the pieces as determined by the illustrated method of assembly. Each texture of this pattern occupies two crossing bands.

While present preferred embodiments and practices of the invention have been illustrated and described, it will be understood that the invention is not limited thereto, but only by the scope of the following claims.

What is claimed is:

1. A three-dimensional assembly puzzle having six physically interchangeable, asymmetrical pieces;

said pieces contacting each other in the assembled puzzle at six regions on the surface of a cube;

said six regions comprising three infacing and three outfacing regions located on three mutually adjacent faces of said cube;

said pieces each having three additional regions of contact to assist in stabilizing said puzzle;

said three regions being parallel to the three orthogonal axes of said cube respectively; and each of said pieces spanning across two adjacent edges of said cube.

2. A puzzle as defined in claim 1 wherein said pieces each consist of two subunits joined together;

each of said subunits being shaped to span an edge of said cube;

each of said subunits having four primary regions of contact with adjacent subunits;

said four primary regions comprising two infacing and two outfacing regions with one of said inface regions and one of said outface regions being located on each of the two faces of said cube adjacent to said edge;

said two subunits being joined together at one outface region on one of said subunits to one inface region on the other of said subunit to form a piece; and said subunit contacting a different subunit at each of said priamry regions remaining unjoined.

3. A puzzle as defined in claim 2 wherein each of said subunits has eight secondary regions in addition to said four regions;

said four primary regions and said eight secondary regions comprising four sets of three nonparallel regions;

said three nonparallel regions contacting the same adjacent subunit;

said three nonparallel regions comprising one of said primary regions and two of said secondary regions; and one of said two secondary regions being parallel to the edge of said cube spanned by said subunit; the other of said two regions being parallel to the edge of said cube spanned by said adjacent subunit.

4. A puzzle defined in claim 2 wherein said puzzle has a substantially symmetrical appearance with joints running from the vicinity of the threefold axes of symmetry of said cube to the vicinity of the fourfold axes of symmetry of said cube.

5. A puzzle as defined in claim 4 wherein said puzzle has holes through it.

6. A puzzle as defined in claim 3 wherein said subunits each extend across each of the orthogonal midplanes of said cube.

7. A puzzle as defined in claim 3 wherein each subunit comprises three geometrical components;

two of said components being substantially the same shape; and the third said component connecting the first two.

8. A puzzle as defined in claim 7 wherein each of said first two components have three mutually orthogonal sides.

9. A puzzle a defined in claim 8 wherein each of said two components has two adjacent sides cut away at 135° from one of said orthogonal sides.

10. A puzzle as defined in claim 9 wherein each of said two components have a round surface on the exterior of the assembled puzzle.

11. A puzzle as defined in claim 10 wherein each of said round surfaces has a surface chracteristic dissimilar to adjacent round surfaces.

12. A puzzle as defined in claim 11 wherein said surfaces comprise six disjoint sets of four surfaces each of said four surfaces each having different surface characteristics to thereby require a unique solution out of 960 possible arrangements.

13. A puzzle as defined in claim 8 wherein each of two said components are substantially orthogonal blocks; and said blocks having their length plus width minus thickness equal to the edge length of said cube.

14. A puzzle as defined in claim 13 wherein said puzzle has the appearance of six interwoven square bands.

15. A puzzle as defined in claim 14 wherein said block's length is greater than said thickness plus said width.

16. A puzzle as defined in claim 15 wherein said bands comprise three sets of two parallel bands; and said two bands sharing a distinctive surface characteristic.

17. A puzzle as defined in claim 16 wherein the arrangement of said pieces has an axis of threefold symmetry and said pieces are uniquely distinguished by said distinctive surface characteristics.

18. A three-dimensional assembly puzzle of symmetrical appearance having a plurality of pieces;

said pieces being combinations of readily distinguishable geometrical components;

said components comprising two symmetrical groups;

the first of said groups comprising twenty-four (24) mutually similar components;

each of said components having a region of contact with each of four adjacent of said components;

the second of said groups comprising twelve (12) mutually similar components;

said second components each having a region of contact with four of said first components comprising two regions on each of two adjacent faces of a single cube;

a plurality of said pieces having six exposed regions on the surface of said cube; and said six exposed regions comprising an infacing and an outfacing region on each of three adjacent faces of said cube.

19. A puzzle as defined in claim 18 wherein said twenty-four (24) components and said twelve (12) components are convex solids.

20. A three-dimensional assembly puzzle having six physically interchangeable asymmetrical pieces;

any pair of said pieces mating in exactly six substantially distinct ways;

said six pieces assembling in exactly three substantially distinct arrangements;

said arrangements dividing into pairs of subassemblies along three mutually perpendicular axes; and said subassemblies comprising six substantially distinct arrangements of said pieces.

* * * * *